United States Patent [19]

Shimazaki

[11] Patent Number: 4,970,729

[45] Date of Patent: Nov. 20, 1990

[54] HELMET

[75] Inventor: Takayuki Shimazaki, Tokyo, Japan

[73] Assignee: Honda Motor Co., Ltd., Tokyo, Japan

[21] Appl. No.: 474,674

[22] Filed: Feb. 6, 1990

Related U.S. Application Data

[63] Continuation of Ser. No. 193,049, May 12, 1988, abandoned.

[30] Foreign Application Priority Data

May 12, 1987 [JP] Japan ..... 62-71181[U]

[51] Int. Cl.[5] ..... A42B 3/02

[52] U.S. Cl. ..... 2/414; 2/181.2

[58] Field of Search ..... 2/181, 181.2, 181.6, 2/181.8, 182.5, 410, 411, 412, 414, 415, 425

[56] References Cited

U.S. PATENT DOCUMENTS

| | | | |
|---|---|---|---|
| 1,842,953 | 1/1932 | Turner | 2/414 |
| 2,634,415 | 4/1953 | Turner et al. | 2/414 |
| 2,785,404 | 3/1957 | Strohm | 2/412 |
| 3,600,713 | 8/1971 | Holt | 2/425 X |
| 3,783,450 | 1/1974 | O'Connor | 2/425 X |
| 3,860,966 | 1/1975 | Brown et al. | 2/415 |
| 3,925,821 | 12/1975 | Lewicki | 2/425 |
| 4,081,865 | 4/1978 | Bergee et al. | 2/425 |
| 4,434,514 | 3/1984 | Sundahl et al. | 2/425 |
| 4,519,099 | 5/1985 | Kamiya et al. | 2/425 X |
| 4,667,348 | 5/1987 | Sundahl | 2/410 |
| 4,698,856 | 10/1987 | Arai | 2/425 |
| 4,736,469 | 4/1988 | Boretti | 2/411 |
| 4,821,344 | 4/1989 | Kamata | 2/414 |

FOREIGN PATENT DOCUMENTS

| | | | |
|---|---|---|---|
| 7906475 | 5/1979 | Fed. Rep. of Germany . | |
| 2952406 | 7/1981 | Fed. Rep. of Germany | 2/411 |
| 3337599 | 4/1985 | Fed. Rep. of Germany | 2/410 |
| 2553266 | 4/1985 | France . | |
| 2048056 | 12/1980 | United Kingdom | 2/410 |
| 8603950 | 7/1986 | World Int. Prop. O. . | |

*Primary Examiner*—Wm. Carter Reynolds

*Attorney, Agent, or Firm*—Birch, Stewart, Kolasch & Birch

[57] ABSTRACT

A helmet with an interior element which fits around the head. The interior element has space therein adjacent the front of the head in order to ensure that there is less pressure on the front hair by the interior element and good air circulation inside the helmet, so that the hair is less disheveled and has less of a steamed look when the helmet is worn.

17 Claims, 6 Drawing Sheets

HELMET

This application is a continuation of application Ser. No. 193,049, filed May 12, 1988, now abandoned.

BACKGROUND OF THE INVENTION

The present invention relates to a helmet of the type used to protect the head when a person is riding a motorcycle or engaged in similar activities. More particularly, the present invention relates to a helmet having a new structural arrangement so the hair styling present on the front head portion of a motorcycle rider will not be disheveled.

In previously known helmets, an outer shell made of a rigid material is provided with an inner liner made from damping material. The inner liner provides a space for receiving a head and has grooves therein for the passage of air in the forward and rearward directions.

In the previously known helmets, the hair of the helmet user, particularly the front hair, is easily disheveled. This occurs because the upper head portion of the user is tightly received within the space provided in the liner, thus the hair is pressed and steamed so that it gives a disheveled appearance.

SUMMARY OF THE INVENTION

The primary object of the present invention is to provide a new helmet constructed to maintain the desired riding, for example.

An additional object is to provide a helmet which is constructed so that the hair is not disheveled when the helmet is put on.

It is a further object of the present invention to provide an arrangement whereby the hair is not disheveled as with the use of previously known helmets.

These and other objects of the present invention are fulfilled by providing a space or recess inside the rigid outer shell, with the recess being located around the front head portion of a person wearing the helmet in order to lessen any pressing of the hair in this area.

When the front hair is received in the above mentioned recess, the air is able to more freely circulate around the hair since there is a lessening of any pressing on the hair by the helmet interior. Thus, there is less pressing and steaming of the hair so that the hair does not become disheveled.

BRIEF DESCRIPTION OF THE DRAWINGS

The present invention will become more fully understand from the detailed description given hereinbelow and the accompanying drawings which are given by way of illustration only, and thus are not limitive of the present invention, and wherein.

DETAILED DESCRIPTION OF PREFERRED EMBODIMENTS

Figure 1:
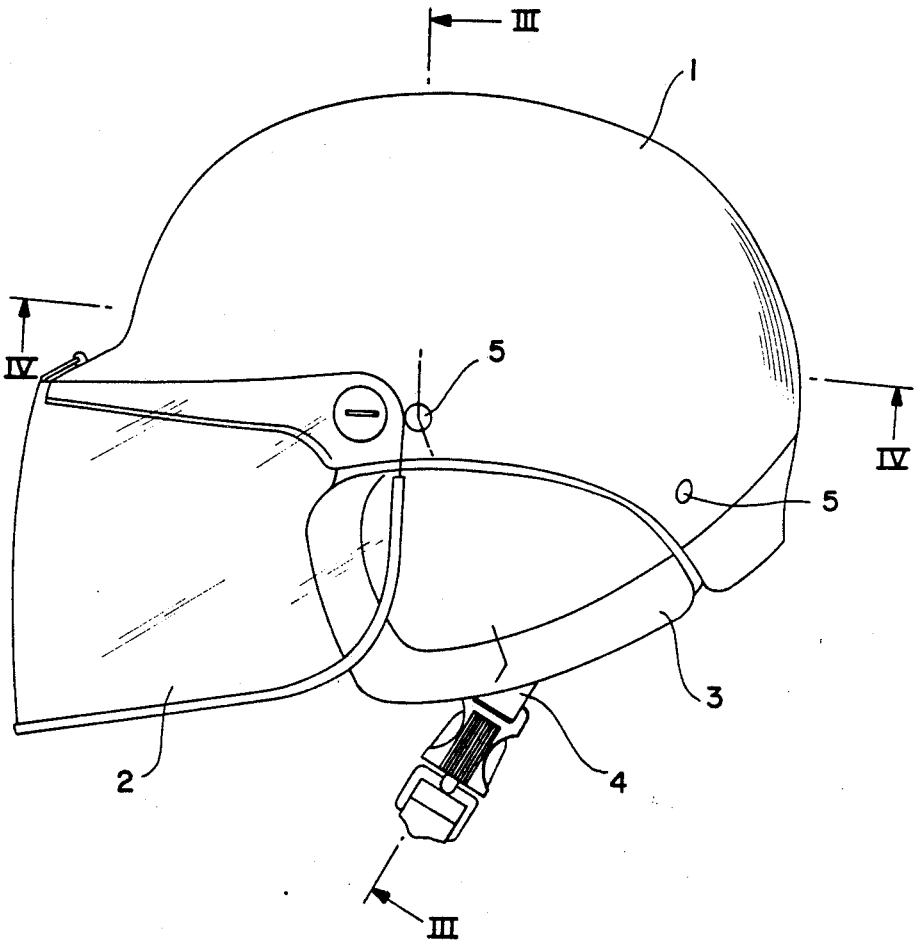
FIG. 1 is a side view of the preferred embodiment of the helmet of the present invention.

Referring in detail to the drawings, there is illustrated in FIG. 1 a helmet having an outer shell 1 made of a rigid material and having a sun visor 2 mounted on the front thereof. Ear covers 3, 3 are provided on both the right and left sides and a chin band 4 is secured to the inside wall of shell 1 by rivets 5,5.

Figure 2:
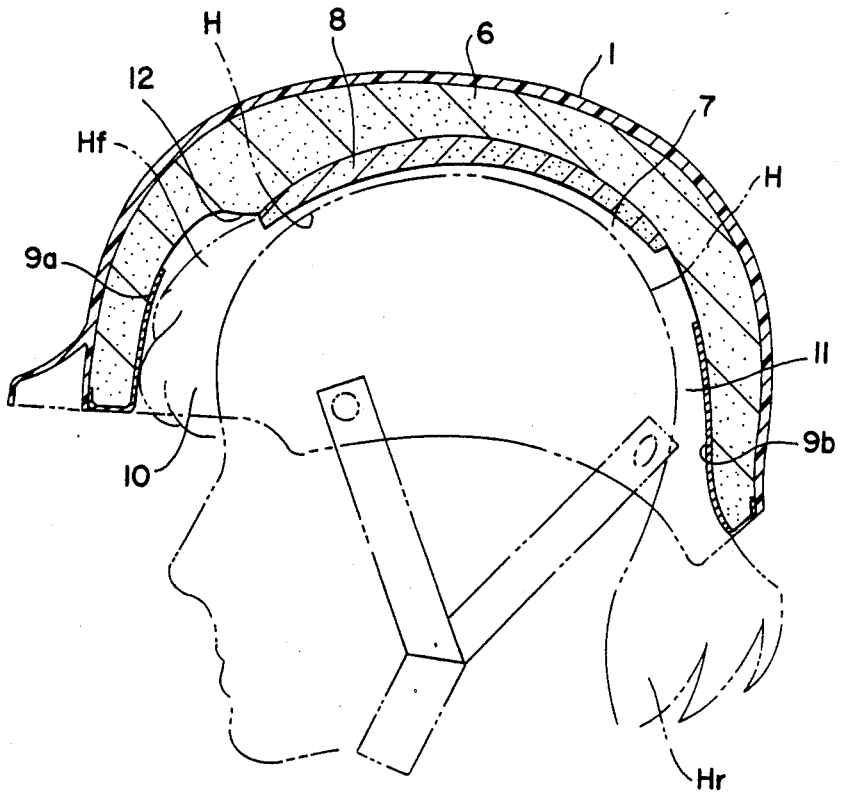
FIG. 2 is a cross-sectional view of the preferred embodiment of the helmet of the present invention.
Figure 3:
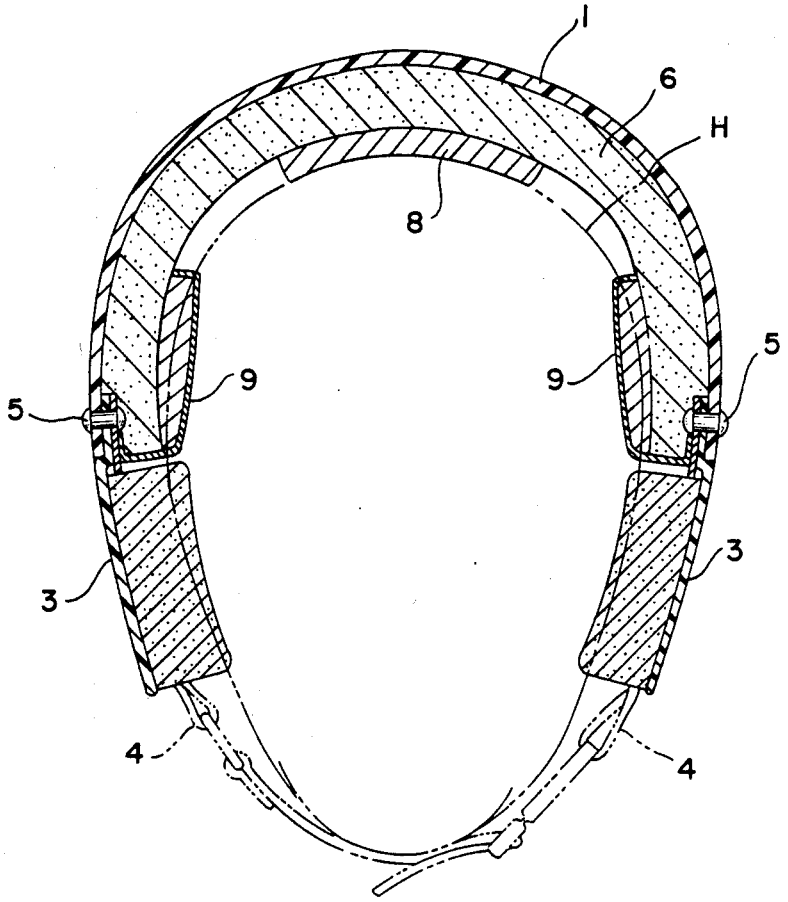
FIG. 3 is a sectional view taken along line III—III in FIG. 1.
Figure 4:
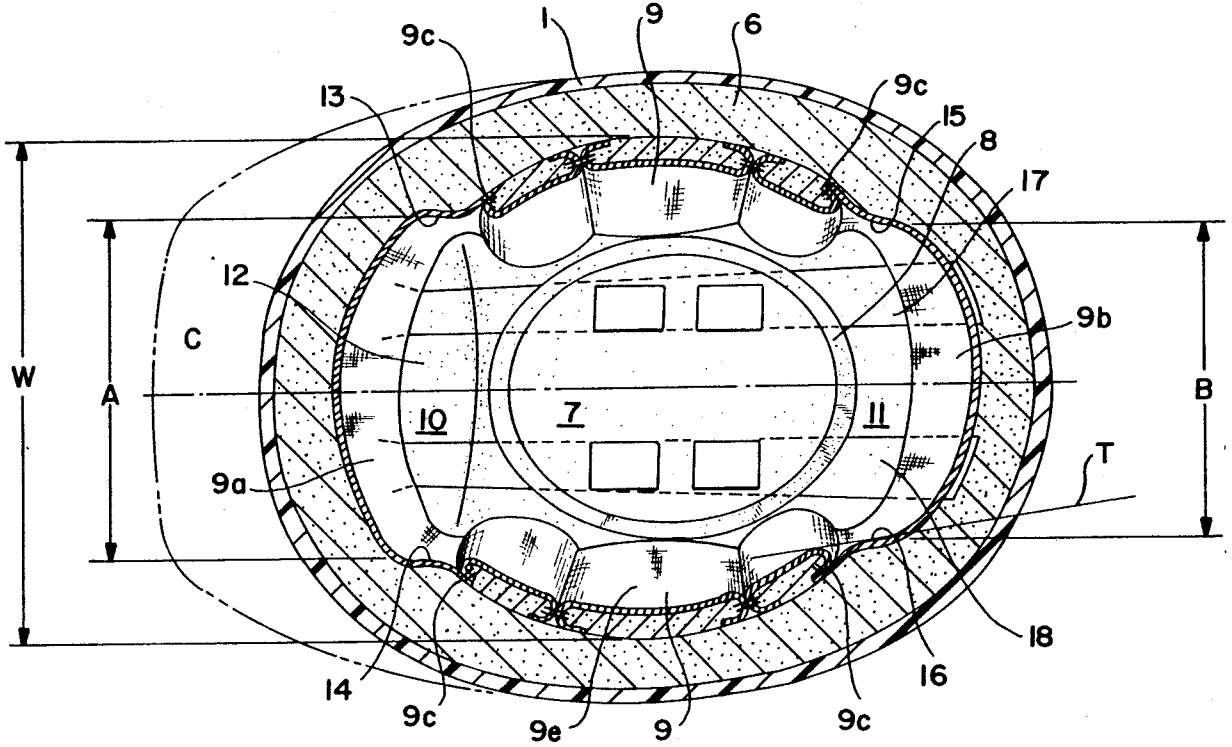
FIG. 4 is a sectional view taken along line IV—IV in FIG. 1.

As shown in FIGS. 2 to 4, a one-piece integral liner or interior element 6 made from damping material, such as Styrofoam, is located inside the shell. The liner 6 has an opening or first space 7 therein for receiving the head of a user. A top pad 8 made from soft material, such as polyurethane foam, is provided at the top of the first space 7 and sweat stopping pads 9, 9, made of polyurethane foam covered with cloth *9e* are fitted at both the right and left sides.

Thus, the liner 6, the top pad 8 and the sweat stopping pads 9, 9 are all provided as interior elements. As shown in FIG. 4, the sweat stopping pads 9,9 are not provided at the front and rear portions of the helmet, but are only located at the right and left sides.

FIG. 2 illustrates a second space 10 and a third space 11, both of which communicate with the first space 7. Mesh type cloth *9a* and *9b* is provided on the interior element at the locations of the second space 10 and the third space 11. The second space 10 and the third space 11 are positioned outwardly from the head outline H of a user, as shown in FIGS. 2 and 4, and provide extra space for front hair and rear hair, respectively.

The first space 7 and the second space 10 are connected by a first step portion 12 located at the top of liner 6 and by second and third step portions 13, 14 located at the sides.

As shown in FIG. 4, fourth step portion 15 and fifth step portion 16 connect the first space 7 to the third space 11.

The first step portion 12, the second step portion 13, the third step portion 14, the fourth step portion 15, the fifth step portion 16 and the sweat stopping pads 9,9 are provided along the head outline H.

As shown in FIG. 4, the second step portion 13 and the third step portion 14 have straight line portions and form deep steps.

The thickness of the liner 6 is the greatest at the first step 12 in order to make the space 10 as large as possible. Further, the space 10 between the liner 6 and the head outline H is the widest at the lowest portion, as shown in FIG. 2. This results in easy conduction of fresh air from the atmosphere to the space 10. In addition, fourth step portion 15 and fifth step portion 16 are also formed so that easy conduction of fresh air from the atmosphere to the space 10 results. FIG. 4 illustrates that fourth step portion 15 and fifth step portion 16 are formed as continuous curves, the tangential line T of which inclines rearwardly to the center line C and thus are formed as comparatively shallow steps.

FIG. 4 also illustrates that width A between second step 13 and third step 14 and width B between fourth step 15 and fifth step 16 have a relationship wherein $A \geqq B$ or A is larger than or equal to B.

Further, the ratio A/W between the width A and the maximum interior width W of the liner 6 is about 100/179 to 120/179.

This range of the ratio A/W provides highly satisfactory conditions while at the same time it provides a good supporting arrangement of the helmet on the head and prevents the hair from being disheveled.

Figure 5:
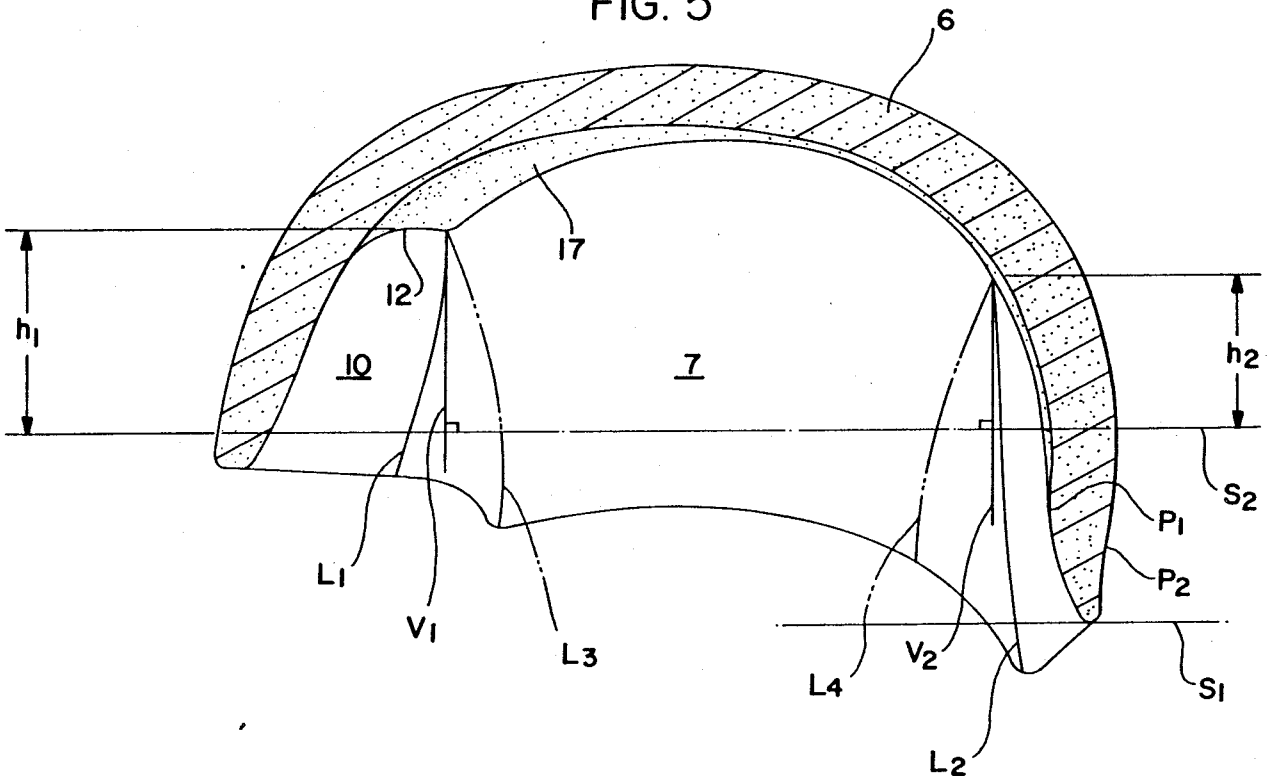
FIG. 5 is a cross-sectional view of the liner.

Air passing grooves 17 and 18 are provided in the surface of the liner 6 and pass through the second space 10 and the third space 11. The air passing grooves 17 and shown in FIG. 4. The deepest portions of each groove are located adjacent the front portion of the first step 12, as shown in FIG. 5.

The construction of air passing grooves 17 and 18 provides that fresh air from the atmosphere can be effectively conducted into the grooves and sent rearwardly, resulting in a remarkable improvement at the cooling effect on the head.

Further, as the third space 11 having the air passing grooves 17 and 18 is constructed and arranged in the rear shell portion, vacuum pressure will be easily generated therein to promote the air passing in the grooves.

The third space 11 is provided at both sides of the shell rearward portion and the air passing grooves 17 and 18 are connected to the third space.

The third space communicates with the atmosphere so that each groove opens to the atmosphere in the rear potion of the interior element in a location where helmet width is decreasing so that there with be positive pulling of air rearwardly because of the generation of a vacuum.

The mesh type cloth **9*b* provided in the third space 11 is encountered by the air from the air passing grooves 17 and 18** and it is effective to prevent the head from being overheated and a steamy condition from taking place.

A seam or seaming portion **9*c* is provided at the connecting portion between each of the mesh type cloths 9*a* and 9*b* and the sweat stopping pads 9 in the first space 7 in such a manner that the tip height of the sweat stopping pads 9 is identical with the steps. In other words, the sweat stopping pads 9 are positioned at the same distance from the center line C as the steps 13, 14, 15 and 16 where the pads are adjacent to the steps, as shown in FIG. 4**.

Figure 6:
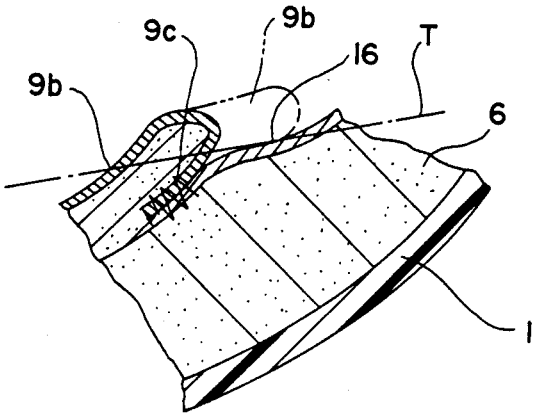
FIG. 6 is an enlarged view of a portion of FIG. 4.

The above construction provides that the second space 10 and the third space 11 are as wide as possible. The seam or seaming portion **9*c* can be constituted as shown in the solid line of FIG. 6 so that the tip is projected from the inner side of the fourth step 15 or the fifth step 16 or as shown in the dotted line of FIG. 6 so that the tip is formed along the fourth step 15 or the fifth step 16** and extends an additional distance toward the center line C, resulting in a soft touching feeling being obtained with the liner edge portion.

Figure 7:
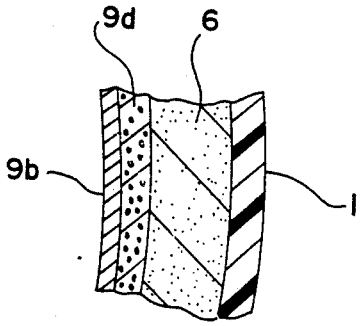
FIG. 7 is a view illustrating the use of sponge material.

Sponge material **9 *d* can be positioned between the mesh type cloth 9*b* and the liner 6 as shown in FIG. 7. This sponge material provides a support for the cloth 9*b*. This construction can be employed in the front portion, as well as the rear portion. Thus, the construction of the seaming portion 9*c* and the use of sponge material lying under the cloth 9*b*** can be utilized in the front portion.

A detailed description of the liner 6 is made below, with particular reference to FIG. 5. L1 and L2 in the drawing denote lines formed at the side portion by steps 13 and 15 which incline outwardly relative to each of the vertical lines V1 and V2. L1 and L2 define the edges of the spaces 10 and 11 respectively. This arrangement establishes a stable support of the helmet.

However, a construction formed as illustrated by the dotted lines L3 and L4, which go along or incline inwardly relative to the vertical lines V1 and V2, makes for less disheveled hair when the helmet is worn.

JIS (Japan Industrial Standard) includes definitions that state that the term "basic plane" is a plane connecting an ear and an eye bottom line and that the term "reference plane" is a plane passing through a specific point parallel to the basic plane. The above basic plane is denoted S1 and the reference plane is denoted S2 in FIG. 5.

The relationship between the height h1 from the reference plane S2 to the highest point of the line L2 should be $h1 > h2$ and the starting or forming position of the fourth step 15 and the fifth step 16 is lower than the first step 12.

The rear end portion of the liner 6 is curved outwardly and the inner and outer curve changing points P1, P2 are located higher than the basic plain S1.

The curve changing point P1 is closer to the reference plane S2 than the curve changing point P2. This construction makes the liner 6 comparatively thinner in order to provide a large enough third space 11 without enlargement of the outer shell.

The function of the preferred embodiment will be described in the following. When a helmet is worn on the head portion H, the head portion H is received in the first space 7 and the front hair Hf and the rear hair Hr are received respectively in the second space 10 and the third space 11. Thus, the hair touches the liner 6 less and is less pressed than in previously known arrangements. According to the present embodiment, the third space 11 provides that disheveled hair will be prevented not only for the front hair Hf, but also for the rear hair Hr.

In addition, it is noted that the first space 7, the second space 10 and the third space 11, all of which are communicated with each other by the air passing grooves 17 and 18, result in a good air breathing condition relative to the hair and less steaming of the head.

The top of the head touches the pad 8, the first step 12 and the sweat stopping pad 9. The front portion of the head touches both the second step 13 and the third step 14, while the rear portion of the head touches the fourth step 15 and the fifth step 16. Therefore, if the head moves in any direction, such as forward and rearward, the helmet will be supported by the above-mentioned construction and kept stable.

The invention being thus described, it will be obvious that the same may be varied in many ways. For example, all of the steps 12, 13, 14, 15 and 16 can be constructed in an inner fitted pad. Such variations are not to be regarded as a departure from the spirit and scope of the invention, and all such modifications as would be obvious to one skilled in the art are intended to be included within the scope of the following claims.

What is claimed is:

1. A helmet comprising:

an outer shell a one-piece integral interior element fitted within said shell, said interior element including a front portion, a rear portion, and a top portion, a first space is provided in said interior element for receiving the head of a user, a second space is provided at the front portion of said interior element by a top step and two sides steps in said interior element, a third space is provided at the rear potion of said interior element, said second space and said third space being open respectively to the atmosphere and positioned outwardly from the head outlined of said user, an airpath is provided in said interior element and extends from said second space of said front portion to said third space of said interior element, and the width of said second space is wider than the width of said airpath, whereby front hair of a person wearing the helmet is not disheveled because there is less pressing and less steaming of the front hair.

2. A helmet according to claim 1, wherein said airpath is at least one groove extending from said front portion of said interior element to said rear potion of said interior element.

3. A helmet according to claim 1, wherein a mesh type cloth is provided on an interior wall of said interior element adjacent said second space and said third space, whereby the circulation of air in this area is improved.

4. A helmet according to claim 1, wherein pads are located within said interior element and extend beyond an interior surface of said interior element so that said surface of said interior element is covered and soft contact is provided with the user's head.

5. A helmet according to claim 1, wherein said top step is located at a maximum thickness of said interior element so that space can be as large as possible.

6. A helmet according to claim 1, wherein said airpath is two grooves, with one of said grooves being located at each side of said interior element.

7. A helmet according to claim 2, wherein said groove opens to the atmosphere in said rear potion of said interior element in a location where helmet width is decreasing so that there will be a positive pulling of air rearwardly because of the generation of a vacuum.

8. A helmet according to claim 2, wherein said groove has a greatest depth located at said top step in said interior element.

9. A helmet according to claim 1, wherein a mesh type cloth is provided on at least a portion of said interior element.

10. A helmet according to claim 1, wherein pads are provided on right and left side walls of said interior element along the head outline and said second space is located between right and left front edges of said pads.

11. A helmet according to claim 1, wherein said interior element is thinner adjacent said second space than adjacent said first space.

12. A helmet according to claim 1, wherein said second space between said interior element and said head outline is widest at its lowermost extent.

13. A helmet according to claim 1, wherein said interior element has side walls and the said interior element is thinner adjacent said second space than at said side walls.

14. A helmet according to claim 1, wherein said airpath is tapered rearwardly and spaced from a center line of said interior element.

15. A helmet comprising an outer shell an interior element including a front portion, a rear portion and a top portion, a first space is provided in said interior element for receiving the head of a user, a second space is provided at the front portion of said interior element, a third space is provided a the rear portion of said interior element, said second space and said third space being open respectively to the atmosphere and positioned outwardly from the head outline of said user, an airpath is provided in said interior element and extends from said second space of said front potion to said third space of said interior element, the width of said second space is wider than the width of said airpath, and wherein a line formed in a cross-sectional view, at a step portion located at a side of said interior element inclines outwardly relative to a vertical line, whereby a stable support of the helmet on a user's head is provided.

16. A helmet comprising an outer shell an interior element fitted within said shell, said interior element including a front portion, a rear potion, and a top portion, a first space is provided in said interior element for receiving the head of a user, a second space is provided at the front portion of said interior element, a third space is provided at the rear portion of said interior element, said second space and said third space being open respectively to the atmosphere and positioned outwardly from the head outline of said user, an airpath is provided in said interior element and extends from said second space of said front portion to said third space of said interior element, the width of said second space is wider than the width of said airpath, and wherein the ratio of the maximum space width to the maximum interior width of said interior element is about 100/179 to 120/179 since this ratio provides both a stable support of the helmet and less disheveled hair.

17. A helmet comprising:

an outer shell a one-piece integral interior element fitted within said shell, said interior element including a front portion, a rear portion, and a top portion, a first space is provided in said interior element for receiving the head of a user, a second space is provided at the front portion of said interior element by a top step and two side steps in said interior element, said second space being open to the atmosphere and positioned outwardly from the head outline of said user, an airpath is provided in said interior element and extends from said second space of said rear portion of said interior element, and the width of said second space is wider then the width of said airpath, whereby front hair of a person wearing the helmet is not disheveled because there is less pressing and less streaming of the front hair.

* * * * *